US008393489B1

(12) United States Patent
Stravitz

(10) Patent No.: US 8,393,489 B1
(45) Date of Patent: Mar. 12, 2013

(54) MEDICAL WASTE DISPOSAL DEVICE WITH SELF-CLOSING LID

(76) Inventor: David M Stravitz, New York, NY (US)

( * ) Notice: Subject to any disclaimer, the term of this patent is extended or adjusted under 35 U.S.C. 154(b) by 0 days.

(21) Appl. No.: 13/568,458

(22) Filed: Aug. 7, 2012

Related U.S. Application Data

(63) Continuation-in-part of application No. 13/161,764, filed on Jun. 16, 2011, now Pat. No. 8,235,237, which is a continuation-in-part of application No. 12/637,252, filed on Dec. 14, 2009, now Pat. No. 7,963,414, and a continuation-in-part of application No. 13/173,001, filed on Jun. 30, 2011, now Pat. No. 8,266,871.

(60) Provisional application No. 61/138,209, filed on Dec. 17, 2008, provisional application No. 61/362,183, filed on Jul. 7, 2010.

(51) Int. Cl.
*B65D 43/26* (2006.01)
*B65B 7/12* (2006.01)

(52) U.S. Cl. ..... 220/264; 220/263; 220/908.1; 53/370

(58) Field of Classification Search ..... 220/263, 220/264, 495.07, 495.08, 908.1; 53/370, 53/483, 567, 576, 577
See application file for complete search history.

(56) References Cited

U.S. PATENT DOCUMENTS

| | | | |
|---|---|---|---|
| 2,946,474 | A | 7/1960 | Knapp |
| 4,470,220 | A | 9/1984 | Sudo |
| 4,576,252 | A | 3/1986 | Omata |
| 4,869,049 | A | 9/1989 | Richards et al. |
| 5,125,526 | A | 6/1992 | Sumanis |
| 5,444,877 | A | 8/1995 | Kumarasurier |
| 5,535,913 | A | 7/1996 | Asbach et al. |
| 5,590,512 | A | 1/1997 | Richards et al. |
| 5,794,277 | A | 8/1998 | Jones |
| 5,813,200 | A | 9/1998 | Jacoby |
| 6,024,238 | A | 2/2000 | Jaros |
| 6,128,890 | A | 10/2000 | Firth |
| 6,145,283 | A | 11/2000 | Noordenbos |
| 6,170,240 | B1 | 1/2001 | Jacoby et al. |
| 6,370,847 | B1 | 4/2002 | Jensen et al. |
| 6,516,588 | B2 | 2/2003 | Jensen et al. |
| 6,561,055 | B1 | 5/2003 | Turk |
| 6,612,099 | B2 | 9/2003 | Stravitz |
| 6,626,316 | B2 | 9/2003 | Yang |
| 6,719,194 | B2 | 4/2004 | Richards |
| 6,804,930 | B2 | 10/2004 | Stravitz |
| 6,851,251 | B2 | 2/2005 | Stravitz |
| 7,114,314 | B2 | 10/2006 | Stravitz |
| 7,146,785 | B2 | 12/2006 | Stravitz |
| 7,316,100 | B2 | 1/2008 | Stravitz et al. |
| 7,374,060 | B2 | 5/2008 | Yang et al. |
| 7,434,377 | B2 | 10/2008 | Stravitz et al. |

(Continued)

OTHER PUBLICATIONS

Analysis of Airborne Microorganisms from Biohazard Waste Containers, Sabrina S. Jedlicka et al., 2011.

*Primary Examiner* — Harry Grosso
(74) *Attorney, Agent, or Firm* — Brian Roffe

(57) ABSTRACT

Waste disposal device includes a container, a lid, and a rotation mechanism that rotates a waste-containing member when present in the container. A slide mechanism enables opening movement of the lid to cause the rotation mechanism to rotate the waste-containing member or prevent the rotation mechanism from rotating the waste-containing member depending on its setting. A foot pedal assembly includes a foot pedal and a spring, and causes both opening of the lid when the foot pedal is depressed and closure of the lid when the pressing force is removed. The spring is moved against its bias upon depression of the foot pedal and returns to its original state when the pressing force is removed to cause closure of the lid and rotation of the waste-containing member. The device may be used for medical waste from hospitals, doctors' offices, home health care personnel and facilities, nursing homes, and biohazard laboratories.

20 Claims, 9 Drawing Sheets

U.S. PATENT DOCUMENTS

| | | | |
|---|---|---|---|
| 7,503,152 | B2 | 3/2009 | Stravitz et al. |
| 7,503,159 | B2 | 3/2009 | Stravitz et al. |
| 7,617,659 | B2 | 11/2009 | Stravitz et al. |
| 7,708,188 | B2 | 5/2010 | Stravitz et al. |
| 7,712,285 | B2 | 5/2010 | Stravitz et al. |
| 7,963,414 | B1 | 6/2011 | Stravitz |
| 2002/0038535 | A1 | 4/2002 | Jensen et al. |
| 2004/0020175 | A1 | 2/2004 | Stravitz |
| 2006/0237461 | A1 | 10/2006 | Chomik et al. |
| 2007/0157581 | A1 | 7/2007 | Webb et al. |
| 2010/0005759 | A1 | 1/2010 | Stravitz |
| 2010/0005762 | A1 | 1/2010 | Stravitz |
| 2010/0006712 | A1 | 1/2010 | Stravitz |

MEDICAL WASTE DISPOSAL DEVICE WITH SELF-CLOSING LID

CROSS-REFERENCE TO RELATED APPLICATIONS

This application is:

1. a continuation-in-part of U.S. patent application Ser. No. 13/161,764 filed Jun. 16, 2011, now U.S. Pat. No. 8,235,237, which is a continuation-in-part of U.S. patent application Ser. No. 12/637,252 filed Dec. 14, 2009, now U.S. Pat. No. 7,963,414, which claims priority under 35 U.S.C. §119(e) of U.S. provisional patent application Ser. No. 61/138,209 filed Dec. 17, 2008, now expired; and 2. a continuation-in-part of U.S. patent application Ser. No. 13/173,001 filed Jun. 30, 2011, which claims priority of U.S. provisional patent application Ser. No. 61/362,183 filed Jul. 7, 2010, now expired, all of which are incorporated by reference herein.

FIELD OF THE INVENTION

The present invention relates generally to waste disposal device that may be used for any type of waste, including but not limited to, medical waste from hospitals, doctors' offices, home health care personnel and facilities, nursing homes, biohazard laboratories, and the like.

The present invention also relates generally to waste disposal devices into which waste products are placed and more particularly to waste disposal devices having a lid which is opened to enable insertion of waste into an interior of the container and automatically closes to thereby cover the interior of the container. More specifically, the invention relates to waste disposal devices that include a rotation mechanism coupled to the lid and a twisting mechanism, which cooperate so that as the lid automatically closes, the rotation mechanism is activated and causes the twisting mechanism to form a twist or knot in a bag or tubing above the inserted waste.

The present invention also relates generally to improvements to waste disposal devices and more specifically to waste disposal devices that enable enhanced control over the rotation mechanism that causes rotation of the twisting mechanism that twists or untwists the bag or tubing extending through the twisting mechanism.

The present invention also relates generally to waste disposal devices that include a manual control, e.g., a slide mechanism, that provides the waste disposal device with two different operating states wherein opening of the lid, via depression of a foot pedal, can either cause unwinding or untwisting of a knot or twist in the bag or tubing or not cause such untwisting or unwinding depending on the operating state of the waste disposal device. In either operating state, closing of the lid causes formation of a twist or knot in the bag or tubing.

The present invention also relates generally to waste disposal devices that reduce outflow of potentially harmful bacteria and fungus from a waste-containing bag or tubing in the waste disposal device during opening of a lid thereof.

BACKGROUND OF THE INVENTION

Small waste disposal devices are common in hospitals, doctors' offices and other locations where waste is generated and must be disposed of in a sanitary manner. Further, if the waste emits odors, the waste disposal device should also contain odors emanating from the waste.

Numerous waste disposal devices exist including those disclosed in U.S. Pat. Nos. 6,612,099, 6,804,930, 6,851,251, 7,114,314, 7,146,785, 7,316,100, 7,434,377, 7,503,152, 7,503,159, 7,617,659, 7,708,188 and 7,712,285, all of which are incorporated by reference herein. Additionally, innovative waste disposal devices are disclosed in U.S. patent application Ser. No. 12/637,252 filed Dec. 14, 2009, now U.S. Pat. No. 7,963,414, also incorporated by reference herein. In addition, waste disposal devices are disclosed in U.S. patent application Ser. Nos. 12/172,715 filed Jul. 14, 2008, 12/172,758 filed Jul. 14, 2008, 12/172,793 filed Jul. 14, 2008, 13/161,764 filed Jun. 16, 2011, 13/172,976 filed Jun. 30, 2011, 13/173,001 filed Jun. 30, 2011, and 13/270,697 filed Oct. 11, 2011, all of which are incorporated by reference herein.

Some of these waste disposal devices include a lid which is coupled to a rotation mechanism whereby upon forced manual closure of the lid, the rotation mechanism converts the manually-initiated closing movement of the lid into rotation of a twisting mechanism which engages with a length of tubing or a plastic bag in the waste disposal device to thereby cause formation of a twist in the tubing or bag. The twist is situated above the waste products in the tubing or bag so that emanation of odors from the waste products in the container is reduced. Such waste disposal devices are disclosed in U.S. Pat. Nos. 6,612,099, 6,804,930, 6,851,251, 7,114,314, 7,146,785, 7,316,100, 7,434,377, 7,503,152, 7,503,159, 7,617,659, 7,708,188 and 7,712,285, all of which are incorporated by reference herein.

A drawback of such waste disposal devices is that closure of the lid is manually initiated so that the person throwing out the waste product must also come into contact with the lid to urge the lid to close. This contact may be difficult if the person is holding other objects and may also lead to transmission of bacteria from the lid to the person.

It has now been found by the inventor herein, and not believed to have been previously appreciated, that it would be desirable to selectively couple the opening of the lid with untwisting or unknotting of the bag or tubing to better facilitate insertion of waste, without permanently altering the control of the rotation mechanism to provide for this ability, i.e., maintaining the ability of the opening of the lid to avoid untwisting of the bag or tubing. This thereby enables a user to have the ability to either untwist or not untwist the bag or tubing upon opening the lid.

Furthermore, it would also be desirable to provide a waste disposal device which does not require a person throwing out waste products to manually handle the lid in order to close the lid.

OBJECTS AND SUMMARY OF THE INVENTION

It is an object of the present invention to provide a new and improved waste disposal device that may be used for any type of waste, including but not limited to, medical waste from hospitals, doctors' offices, home health care personnel and facilities, nursing homes, biohazard laboratories, and the like.

It is another object of the present invention to provide new and improved waste disposal devices including a lid which can be closed without manual initiation or contact and whose closure causes rotation of a waste-containing member in general or more specifically, a twisting mechanism which engages with a length of tubing or a bag in the waste disposal device to thereby form a twist in the tubing or bag.

Another object of the present invention is to provide a waste disposal device that enables opening of the lid to untwist a bag or tubing to better facilitate insertion of waste while also providing the capability that opening of the lid avoids untwisting of the bag or tubing.

In order to achieve at least one of these object and others, a waste disposal device adapted to receive a waste-containing member in accordance with the invention includes a container defining a waste-receiving compartment having an opening, a lid connected to the container and having a first, closed position covering the opening of the container and a second, open position in which the opening is exposed, and a rotation mechanism arranged in the container to rotate the waste-containing member when present in the container. The rotation mechanism is arranged to rotate the waste-containing member upon closure of the lid without manual handling of the lid.

In one embodiment, the rotation mechanism includes at least one rack gear coupled to the lid at an upper end region thereof and a gear assembly having a first gear in meshing engagement with the rack gear(s), and a second, drive gear in meshing engagement with the waste-containing member and which is rotationally coupled to the first gear. The gear assembly may also include at least one additional gear interposed between the first gear and the second gear to transfer rotation of the first gear to the second gear. The rack gear is arranged such that its downward movement, obtained in a manner described below, causes rotation of the waste-containing member by means of the gear assembly.

The waste disposal device also includes a slide mechanism that enables, when in one position, state, condition or setting, opening movement of the lid to cause the rotation mechanism to rotate the waste-containing member or, when in another position, state, condition or setting, prevents the rotation mechanism from rotating the waste-containing member.

The waste disposal device also includes a foot pedal assembly which causes both opening of the lid when depressed and closure of the lid when the pressing force is removed. Specifically, the foot pedal assembly includes a foot pedal which extends outward from a lower region of the container, and a horizontal actuating member connected to the foot pedal at a first end region. The foot pedal assembly also includes a spring that is moved against its bias upon depression of the foot pedal and returns to its original state when the pressing force on the foot pedal is removed. Further, the spring is coupled to the rack gear(s) such that when the spring returns to its original state, the spring pulls the rack gear(s) downward and thereby enables or causes closure of the lid and rotation of the waste-containing member. The spring is a compression spring and is part of a spring assembly. The spring assembly also includes a rod around which the spring is positioned, and which rod is attached at a lower end region to the horizontal actuating member and at an upper end region to the rotation mechanism. The rod may be connected to the frame that is pivotally coupled to the lid at an upper end region thereof and on which the rack gear(s) is/are arranged. Retaining members may be provided to retain upper and lower ends of the spring.

BRIEF DESCRIPTION OF THE DRAWINGS

The invention, together with further objects and advantages thereof, may best be understood by reference to the following description taken in conjunction with the accompanying drawings, wherein like reference numerals identify like elements, and wherein.

DETAILED DESCRIPTION OF THE INVENTION

Figure 1:
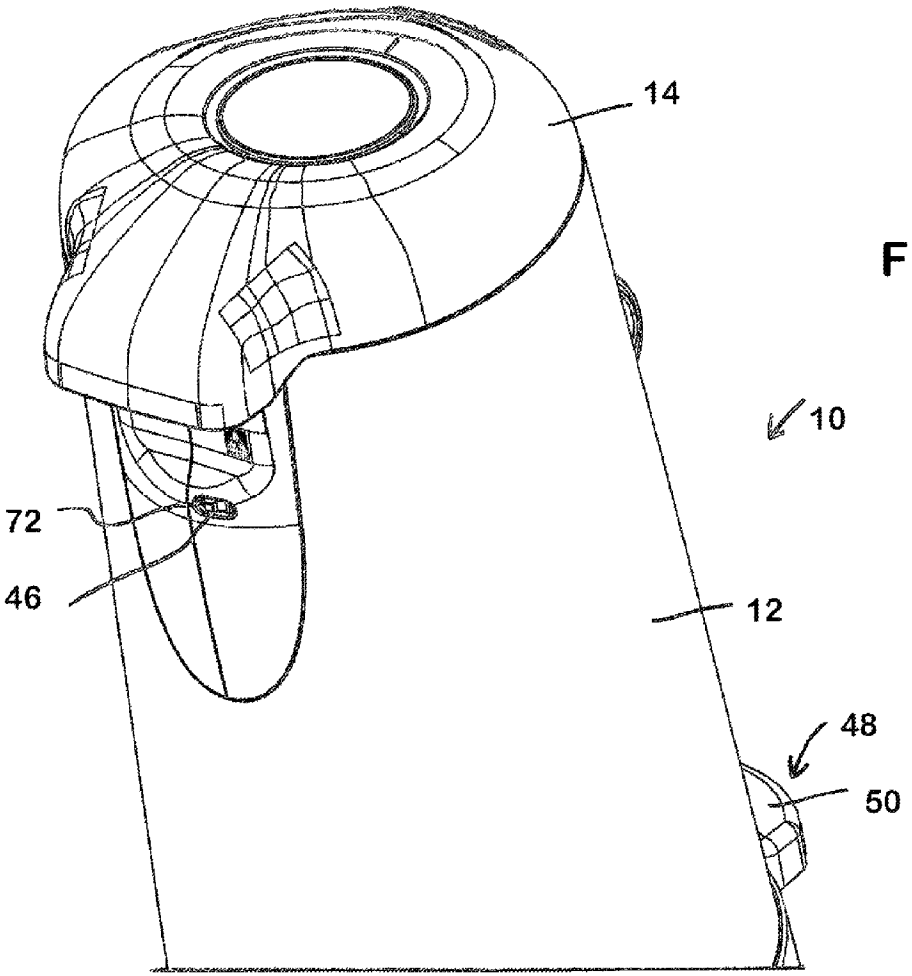
FIG. 1 is a side perspective view of a waste disposal device in accordance with the invention.
Figure 2:
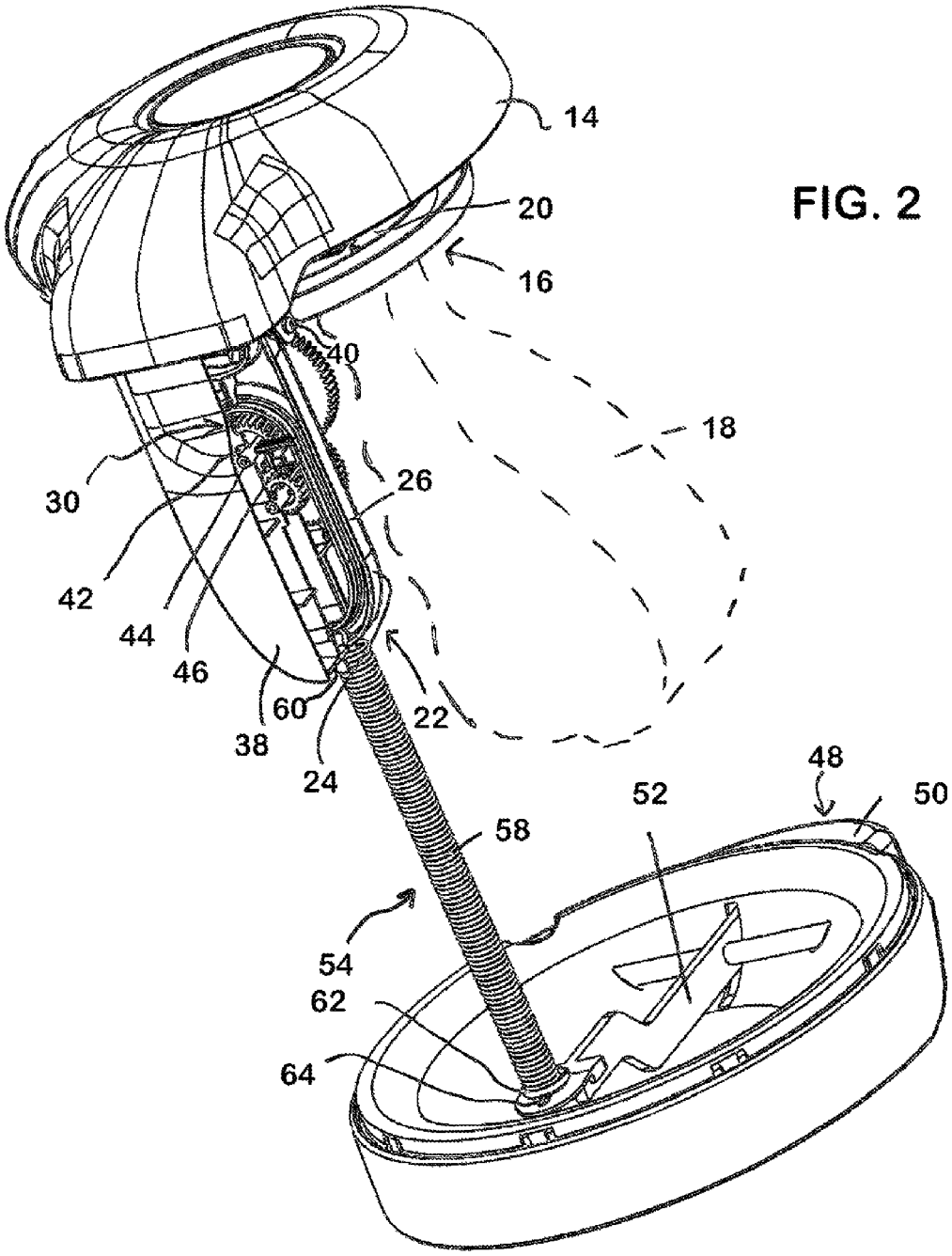
FIG. 2 is a perspective view of principal parts of the waste disposal device shown in FIG. 1 when a slide mechanism is in a trapping state.
Figure 3:
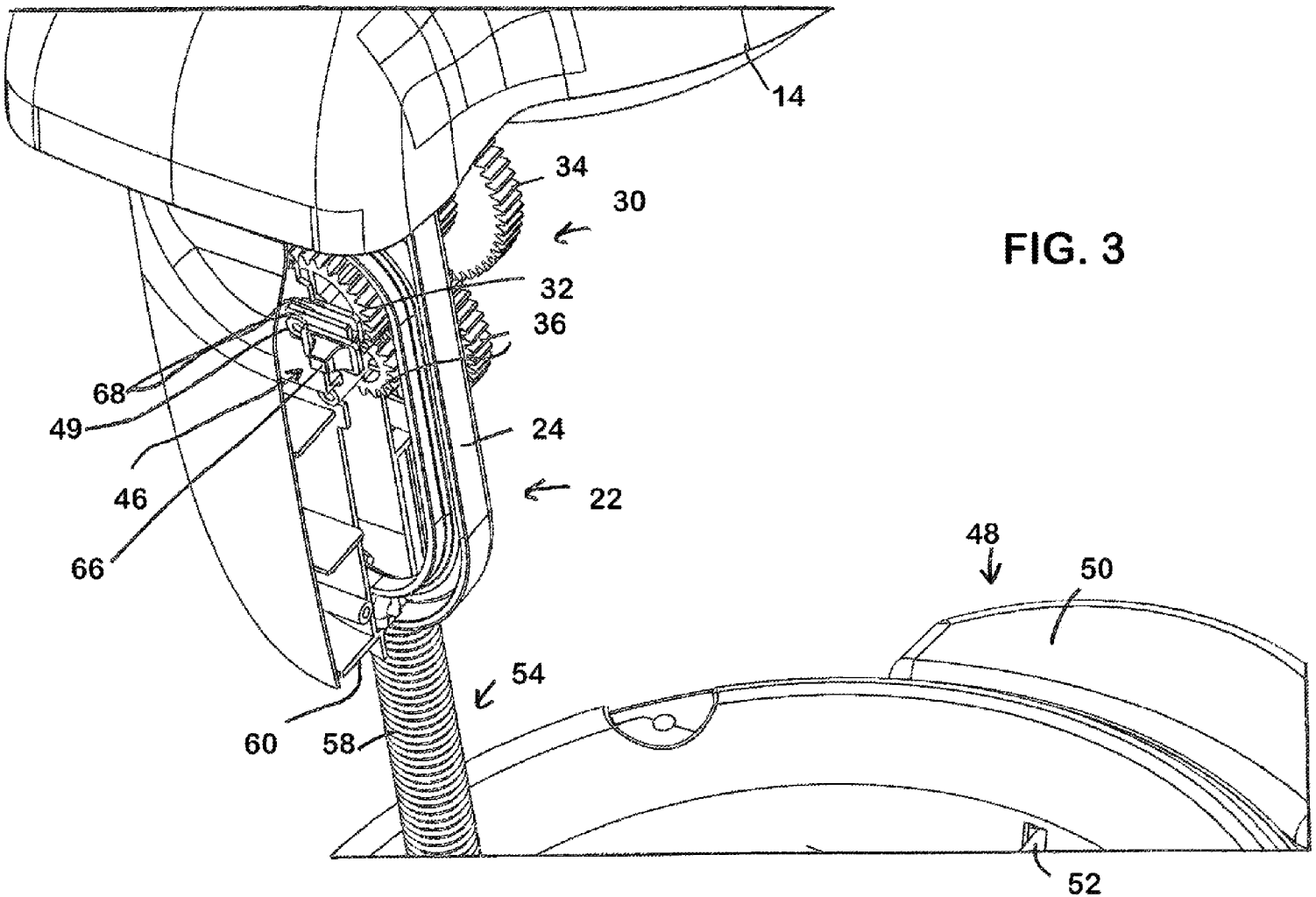
FIGS. 3 and 4 show principal parts of the waste disposal device shown in FIG. 1 when the slide mechanism is in a trapping state.
Figure 4:
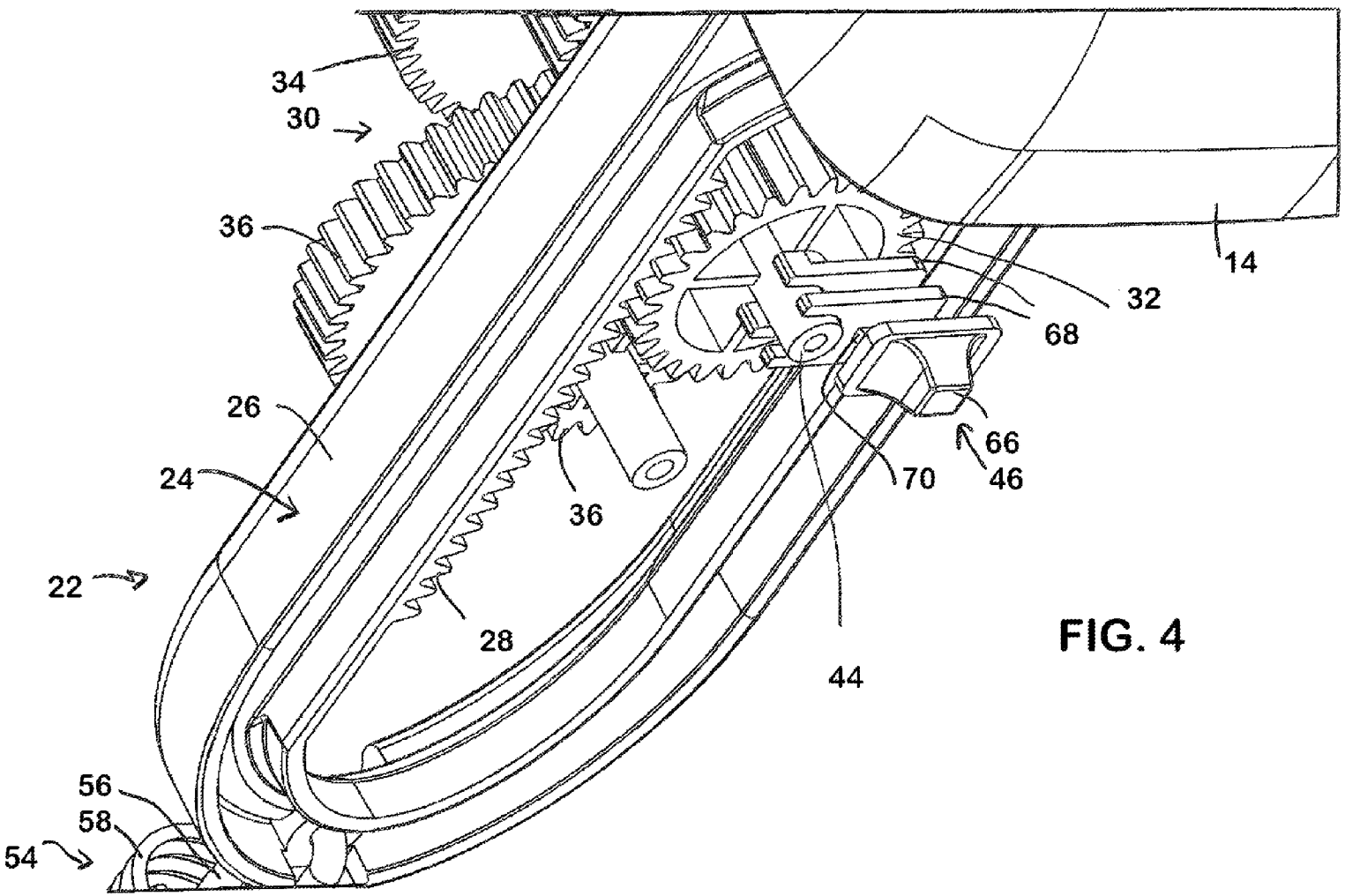

Referring to the accompanying drawings wherein like reference numerals refer to the same or similar elements, FIGS. 1 and 2 show a waste disposal device in accordance with the invention which is designated generally as 10 and includes a substantially cylindrical container 12 having an outer wall and a base arranged at the lower end region of the outer wall, and which defines a waste-receiving compartment. A lid 14 is pivotally connected to the outer wall so as to be movable between an open position in which a waste insertion opening leading to the waste-receiving compartment is exposed to enable insertion of waste into the container 12 and a closed position in which the lid 14 overlies and closes the waste insertion opening.

Figure 9:
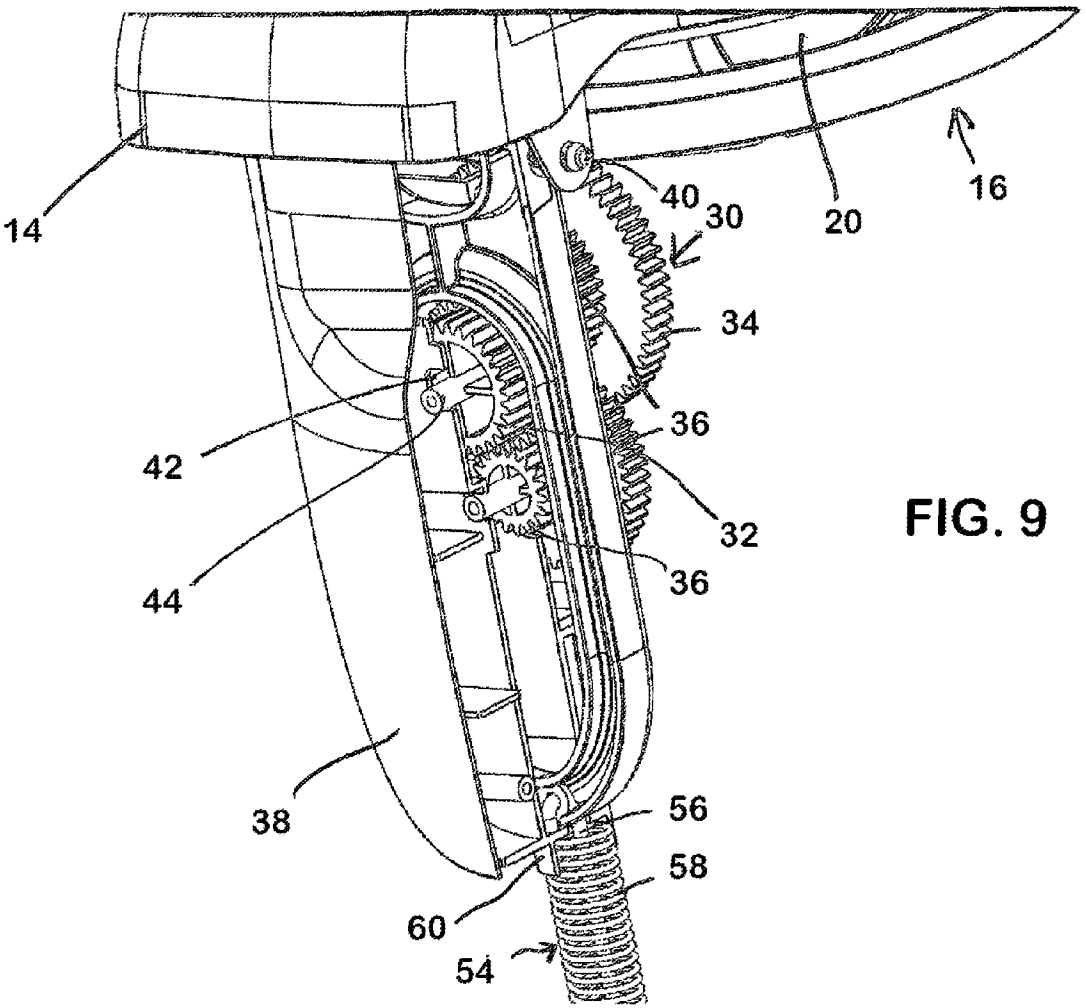
FIG. 9 shows principal parts of the waste disposal device shown in FIG. 1 when the slide mechanism is removed.

A general feature of waste disposal device 10 is that there is rotation of a twisting mechanism 16, only a portion of which is shown in FIGS. 2 and 9, which engages with tubing or a bag, hereinafter referred to as a waste-containing member 18, relative to a stationary support or cartridge (not shown) which supports or retains the waste-containing member 18 into which the waste is placed to thereby cause the formation of a twist in the waste-containing member 18. Rotation of this waste-containing member 18 or the twisting mechanism 16 thereof would occur after insertion of waste to thereby form a twist above the inserted waste and inhibit release of odors from the waste. Additional details about such twisting mechanisms is found in U.S. patent application Ser. Nos. 12/637,252, 13/161,764, 13/172,976, 13/173,001, and 13/270,697.

To implement this technique, the twisting mechanism 16 is movably seated on a support flange of the container and may have any of several constructions known in the prior art. One such twisting mechanism includes a twisting member having a substantially tubular outer wall, a substantially tubular inner wall, a substantially planar bottom support wall and a circular gear rim adjoining the outer wall and on which projections are formed. The bottom support wall is not contiguous between the outer and inner walls and apertures may be formed therein. The gear rim and its projections may be formed integral or unitary with the twisting member or separate therefrom and then attached thereto.

The twisting mechanism 16 also includes a grasping member such as a membrane 20 (partially shown in FIGS. 2 and 9) arranged to engage with waste-containing member 18. When the twisting mechanism 16 is rotated, the engagement of the membrane 20 with the waste-containing member 18 causes the waste-containing member 18 to be twisted, i.e., form a twist in the waste-containing member 18. The engagement of the waste-containing member 18 with the membrane 20 arises since the waste-containing member 18 passes through one or more of the slots between fingers of the membrane 20 (see FIGS. 12B, 13B and 38 of U.S. patent application Ser.

No. 13/173,001). The slots define an aperture through which the waste-containing member 18 passes. Note that the waste-containing member 18 may pass through only one slot, or only partially through one slot, or only partially through two or more slots, or only through the center at the intersection of the slots, and the exact manner depends on the actual use of the waste disposal device.

An aperture, through which the waste-containing member 18 passes, may be formed in the membrane 20 by other means, including, barely discernible small slits extending from a frame supporting the outer edge of the membrane 20 to a center. The membrane 20 may be formed and constructed in different ways and is not limited to the presence of six fingers separated by slots. The material of the fingers may be selected to be flexible so that they flex downward in a direction away from the center when a person pushes waste through the central region of the membrane 20. The material of the fingers should also be resilient so that the fingers return to their initial form after the person has removed their hand from engagement with the membrane 20, or the inserted waste has been pushed downward through the membrane 20 and is no longer in engagement therewith. For example, the membrane 20 may be made of silicone or another rubbery material. It may also be made of a flexible synthetic material which flexes under pressure and returns when pressure is removed.

The waste-containing member 18 passing through the slots may tend to flex the fingers downward but the fingers will still remain in engagement with the waste-containing member 18 and enable it to be twisted in the manner described below upon rotation of the membrane 20. The edges of the fingers which are expected to engage the waste-containing member 18 may be provided with a friction-enhancing material to increase the contact force between the fingers and the waste-containing member 18.

The membrane 20 (partly shown in FIGS. 2 and 9) may be formed integral with the twisting member of the twisting mechanism 16 or separate therefrom and then attached thereto. For example, the membrane 20 may include an annular channel on its underside which frictionally engages with an annular projection on the twisting member of the twisting mechanism 16. Friction between the projection on the twisting member of the twisting mechanism 16 and the edges of the channel on the membrane 20 enables the membrane 20 to be securely retained on the twisting member of the twisting mechanism 16 and thus rotated upon and in conjunction with rotation of the twisting member of the twisting mechanism 16.

Any other structure for fixing the membrane 20 to the twisting member to enable them to rotate together may also be used. Instead of the membrane 20, another form of a grasping member may be used. The general function of such a grasping member is to engage with the waste-containing member 18 as the waste-containing member 18 passes by it and is capable of twisting the waste-containing member 18 when rotated. For example, the grasping member may be a circular frame having fingers extending inwardly therefrom, or have a comparable structure as disclosed in prior art waste disposal devices.

In order to provide for rotation of the twisting member of the twisting mechanism 16 relative to the waste-containing member 18 which is held in a stationary state and thus provide for the formation of a twist in the waste-containing member 18 in the slot(s) between the fingers of the membrane 20 (and which is engaged by the fingers), a mechanism for preventing rotation of the waste-containing member is preferably provided. The anti-rotation mechanism or rotation preventing mechanism may be any of those constructions known in the prior art. For example, if the waste-containing member 18 is tubing housed in a cartridge, then the cartridge could be provided with a plurality of indentations, e.g., four, six, eight, that receive projections on the housing of the container 12. On the other hand, the waste-containing member may be a bag such as disclosed in U.S. patent application Ser. No. 12/172,758, see FIGS. 11-13 thereof.

As shown in FIGS. 2-4, 6 and 7, a rotation mechanism 22 is provided to rotate whatever twisting mechanism 16 is arranged in the container 12, upon only closure of the lid 14 or both upon closure and opening of the lid 14 (the two different settings of the waste disposal device 10 and the structure which makes these different operations possible are described below). Rotation mechanism 22 includes a substantially U-shaped rack gear assembly 24 (see, e.g., FIGS. 2-7). The U-shaped rack gear assembly 24 includes a substantially U-shaped frame 26 which is pivotally coupled to the lid 14 at the upper ends of the U-shape via one or more pivot pins 40 (see FIGS. 2 and 9) and a rack gear 28 on the inside surface of one or both of the legs of the U-shaped frame 26 (see FIGS. 4 and 5). Each rack gear 28 has a series of teeth on at least a portion of a longitudinally extending surface (see FIGS. 4 and 5).

Instead of a U-shaped rack gear assembly 24 having a U-shaped frame 26, a rack gear assembly having a frame with a different form may be used, or a frame may be entirely omitted. Also, only a single elongate rack gear 28 may be provided. Thus, in a waste disposal device in accordance with the invention, there may be at a minimum, only a single rack gear coupled to the lid 14 and which moves vertically in one direction upon opening of the lid 14 and vertically in the opposite direction upon closing of the lid 14.

The rotation mechanism 22 also includes a gear assembly 30 (FIGS. 2-5 having one gear 32 in meshing engagement with the rack gear 28 (see FIG. 4) and one gear 34 in meshing engagement with the projections on the twisting member (this gear being referred to as the drive gear), and then optionally one or more additional gears 36 interposed between the gear 32 in engagement with the rack gear 28 and the drive gear 34. The gear assembly 30, except for a portion of the drive gear 34 which engages with the twisting member, may be situated in a housing 38 (see FIGS. 2, 3 and 9).

Gear assembly 30 also includes an appropriate mechanism for selectively enabling one-way transmission of rotational force from the rack gear 28 to the drive gear 34 (described below). Such mechanisms are known in the prior art. Other gear assemblies including more or less gears than shown can also be used to convert the downward movement of the rack gear 28 into rotational movement of the drive gear 34 in only a single direction. For example, a bevel gear may be used.

In operation, when the lid 14 is closed, the U-shaped frame 26 and thus the rack gear 28 are moved downward causing rotation of the gears 32, 36 in the gear assembly 30 and ultimately rotation of the drive gear 34. A shaft 44 of the gear 32 is moved against an edge of an elongate slot 42 during the closing movement of the lid 14 thereby fixing the gear 32 in a gear transmission between the rack gear 28 and the drive gear 34. The twisting member of the twisting mechanism 16 is thus caused to rotate in view of the engagement between the projections on the gear rim of the twisting member and the drive gear 34. As such, the closing movement of the lid 14 is converted into rotational movement of the twisting member of the twisting mechanism 16. Other mechanisms for converting the closing movement of the lid 14 into rotational movement of the twisting member of the twisting mechanism 16 are also contemplated within the scope of the invention and include those known in the prior art.

Opening movement of the lid 14 is selectively converted into rotational movement of the twisting member of the twisting assembly 16 depending on whether the shaft 44 of the gear 32 is retained by a slide mechanism 46 or not. To effect this operation, slide means are provided that can be set to one of two different positions to regulate rotation of the waste-containing member 18 based on opening movement of the lid 14 such that when the slide mechanism 46 is in one position, the opening movement of the lid 14 allows the rotation mechanism 22 to rotate the waste-containing member 18 and when the slide mechanism 46 is in the other position, the opening movement of the lid 14 does not allow the rotation mechanism 22 to rotate the waste-containing member 18. Several examples of such means are described below.

When retained by the slide mechanism 46 (one position of the slide mechanism 46 shown in FIGS. 3-5), the gear 32 or its shaft 44 is trapped by the slide mechanism 46 in a position in which the shaft 44 is not movable in a radial direction and thus maintains the motive coupling between the lid 14 and the drive gear 34. This produces an unwind or untwisting effect of the waste-containing member 18 when the lid 14 is opened.

However, when the shaft 44 of the gear 32 is not retained (a second position of the slide mechanism 46 shown in FIGS. 6-8), the shaft 44 is freely movable in the elongate slot 42 and thus moves upward in the slot 42 and is not pressed against an edge of the slot 42 during the opening movement of the lid 14. This disrupts the motive coupling between the lid 14 and the drive gear 34, i.e., this movement of the gear 32 prevents motive transmission between the rack gear 28 and the drive gear 34. The slot 42, which may be oval, thus enables movement of the shaft 44 and thereby prevents unwinding or untwisting of the twist or knot in the waste-containing member 18 when the lid 14.

Accordingly, during opening movement of the lid 14, the position of the slide mechanism 46 determines whether the twisting member of the twisting assembly 16 will be rotated or not. Additional details about the slide mechanism 46 are described below. The waste disposal device 10 also includes a foot pedal assembly 48 which causes both opening of the lid 14 when a foot pedal of the foot pedal assembly 48 is depressed and closure of the lid 14 when the pressing force is removed. The foot pedal assembly 48 may be considered part of the rotation mechanism 22 or not.

The foot pedal assembly 48 includes the foot pedal 50 which extends outward from a lower region of the container 12, a horizontal actuating member 52 connected to the foot pedal 50 at a first end region and a spring and rod assembly 54, hereinafter referred to as a spring assembly (see FIG. 2). Spring assembly 54 includes a bar or rod 56, e.g., a ¼ inch diameter rod, mounted at a lower region to the horizontal actuating member 52 (see FIG. 2) and attached at an upper region to the rack gear assembly 22, e.g., to a bottom portion of the U-shaped frame 26 thereof (see FIGS. 4 and 5).

Circumventing or around the rod 56 is a compression spring 58 (see FIGS. 2, 4 and 5) that should be large enough in diameter to freely compress and relax over the rod 56. Rod 56 may have a circular cross-section or round profile, and can also have a square or other profiles as long as it fits inside the spring 58 and the spring 58 can compress and relax freely.

The spring 58 is designed to replace the manual force applied by the user to engage the gear assembly 30. In effect, the spring 58 stores force during the opening of the lid 14 by user depression of the foot pedal 50 and this stored force is applied to close the lid 14 and cause the rotational movement of the twisting member of the twisting mechanism 16.

The compression spring 58 can be a full length spring extending entirely between the U-shaped frame 26 and the horizontal actuating member 52 (see FIG. 2). It can also be a shorter spring that engages the rack gear assembly 22 and a welded place along the rod 56, for example. The compression spring 58 is essentially trapped on the top in the gear housing 38, by a retaining member 60 (see FIGS. 2 and 3), and on the bottom in a cupped recessed area along the rod 56, bar or other profile by means of another retaining member (see FIG. 2).

A bottom area of the spring assembly 54 has a welded, slightly less than half moon (a portion of a sphere), rounded part 62 that is welded or otherwise fastened to the bottom area of the rod 56 (see FIG. 2). The extension of this is a partially threaded rod that goes through a slot 64 in the back slotted portion of the horizontal actuating member 52 (see FIG. 2). The function and additional constructional details of the spring assembly and its attachment to the horizontal actuating member 52 are set forth in U.S. patent application Ser. No. 13/173,001.

When the lid 14 is closed, or after releasing the foot pedal 50, the compression spring 58 is in a relaxed position and the waste in the bag or tubing 18 has been rotated. When the lid 14 is opened by stepping on the foot pedal 50, the spring 58 is compressed to cause tension to push up the rack gear assembly 22 and at the same time, unwinds or does not unwind the bag or tubing 18 depending on the position of the slide mechanism 46 (as discussed above). Upon releasing the foot pedal 50, the compression spring 58 returns to its uncompressed or original state and urges the lid 14 to close because the compression spring 58 pulls down on the rack gear assembly 22 because of the relaxation of the compression spring 58, thus turning the bag or tubing 18.

There are many ways to attach or fasten the rod 56 of the spring assembly 54 to the rack gear assembly 22. For example, a 90 degree hooked portion of the rod 56 may be attached to the U-shaped frame 26 of the rack gear assembly 24 using a nut. In another embodiment, a 180 degree U-shaped hook of the rod 56 engages a hole in the U-shaped frame 26 of the rack gear assembly 22 by looping through it, thus eliminating the need for the 90 degree version requiring a nut to lock the rod 56 to the rack gear assembly 22. Obviously, there are other ways to engage the rod 56 into the rack gear assembly 22, and all are contemplated to be within the scope and spirit of the invention.

One such method, not shown, is to have the end of the top of the rod 56 be straight and threaded while a bottom central portion of the rack gear assembly 20, e.g., the U-shaped frame 26 or a rack gear 28 thereof, could be machine threaded to accept the threaded top of the rod 56. For manufacture, the user would screw the rod 56 directly into the threaded portion of the rack gear assembly 22. For extra strength, the rack gear assembly 22 could have a metal threaded insert and could be "Insert Molded" directly at the point of injection molding of the rack gear assembly 22 or U-shaped frame 26 thereof. The rack gear 28 itself may also be threaded to accept the threaded end of the rod 56. Or, the U-shaped frame 26 or a rack gear 28 thereof, or other part of the rack gear assembly 22, can be actually machined or dye cast of a metal substrate and the threads would be cast or machine threaded. Whether insert molded or made entirely of metal, the rod 56 would be securely engaged into the base of the U-shaped frame 26 of the rack gear assembly 22.

As mentioned above, slide mechanism 46 enables the opening movement of the lid 14 to either cause rotation of the twisting mechanism 16 via the rotation mechanism 22 or prevent rotation of the twisting mechanism 16, depending on the position of the slide mechanism 46. Two different positions, conditions or states of the slide mechanism 46 may be indicated by text on the outer surface of the container 12, e.g., the word "LOCK" with an arrow in one direction and the word "RELEASE" with an arrow in the other direction.

Slide mechanism 46 provides a double engagement on two parts of the shaft 44 of the gear 32, that are axially separate from one another, and causes the shaft 44 to be trapped or untrapped in the gear chain between the lid 14 and the twisting mechanism 16 when the slide mechanism 46 is in engagement with the shaft 44. Alternatively, may be a slide lock with a single engagement on only one side of the shaft 44 as shown in FIGS. 28-32 of U.S. patent application Ser. No. 13/173,001. Even more generally, the slide mechanism 46 is designed to regulate motive coupling through the rotation mechanism 22, either allowing motive coupling to be transferred from the rack gear 28 to the drive gear 34 or preventing such transfer.

Slide mechanism 46 is effective to trap the shaft 44 of the gear 32 and prevent its radial movement and thus prevent disengagement of gear 32 from the gear chain upon lifting of the lid 14. As a result, the opening of the lid 14 will create an unwinding condition (when the slide mechanism 46 is in the trapping position shown in FIGS. 3-5).

Slide mechanism 46 includes a slide 66, two spaced apart trapping portions 68 and a connecting portion 70 therebetween (see FIGS. 4, 5, 7 and 8). Slide 66 is positioned to be accessible through an opening 72 in the container 12 (see FIGS. 5 and 8) to enable the slide mechanism 46 to be manually actuated into or out of engagement with the shaft 44.

Figure 5:
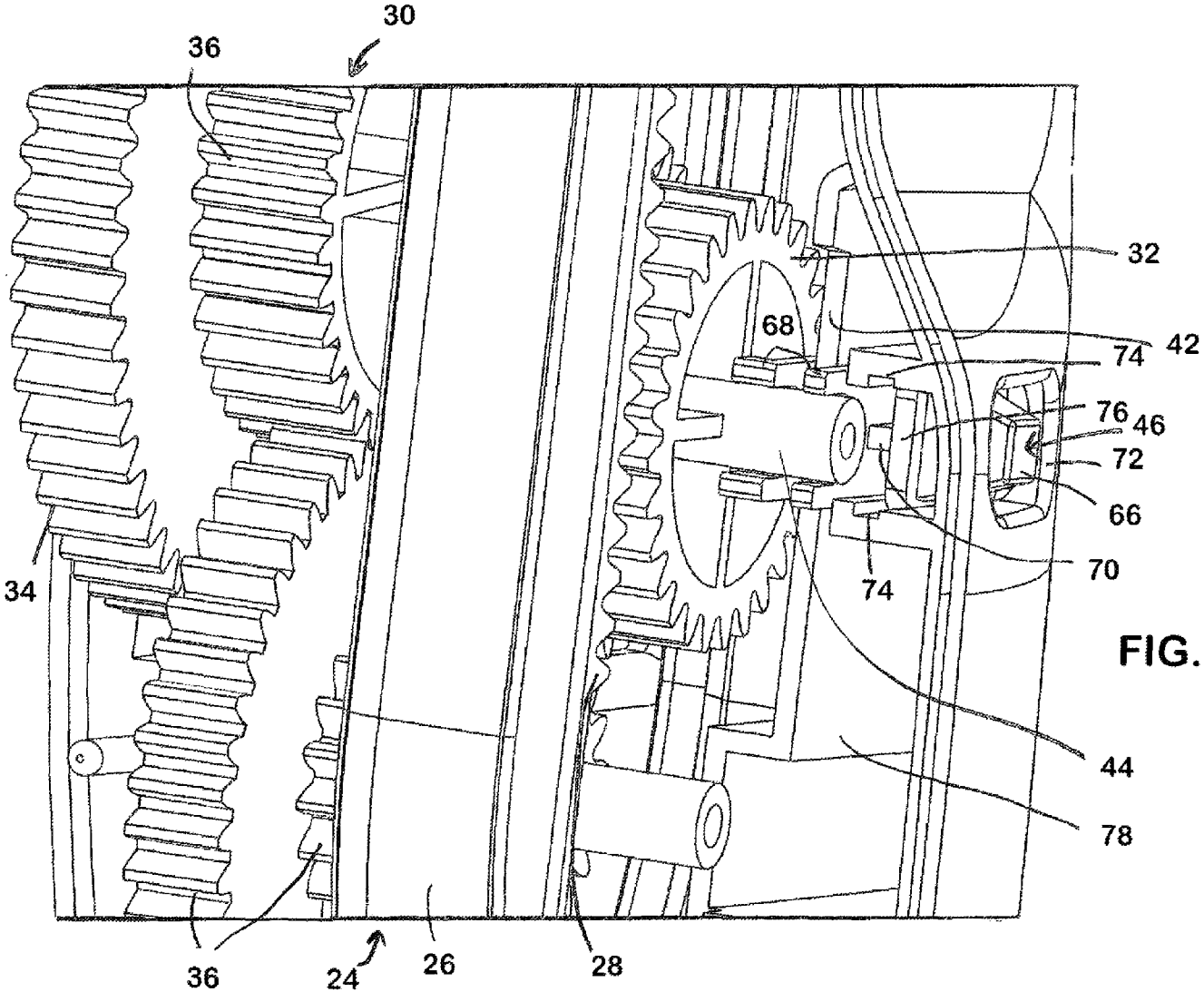
FIG. 5 shows principal parts of the waste disposal device shown in FIG. 1 when a slide mechanism is in a trapping state with the wall of the container partially removed.
Figure 6:
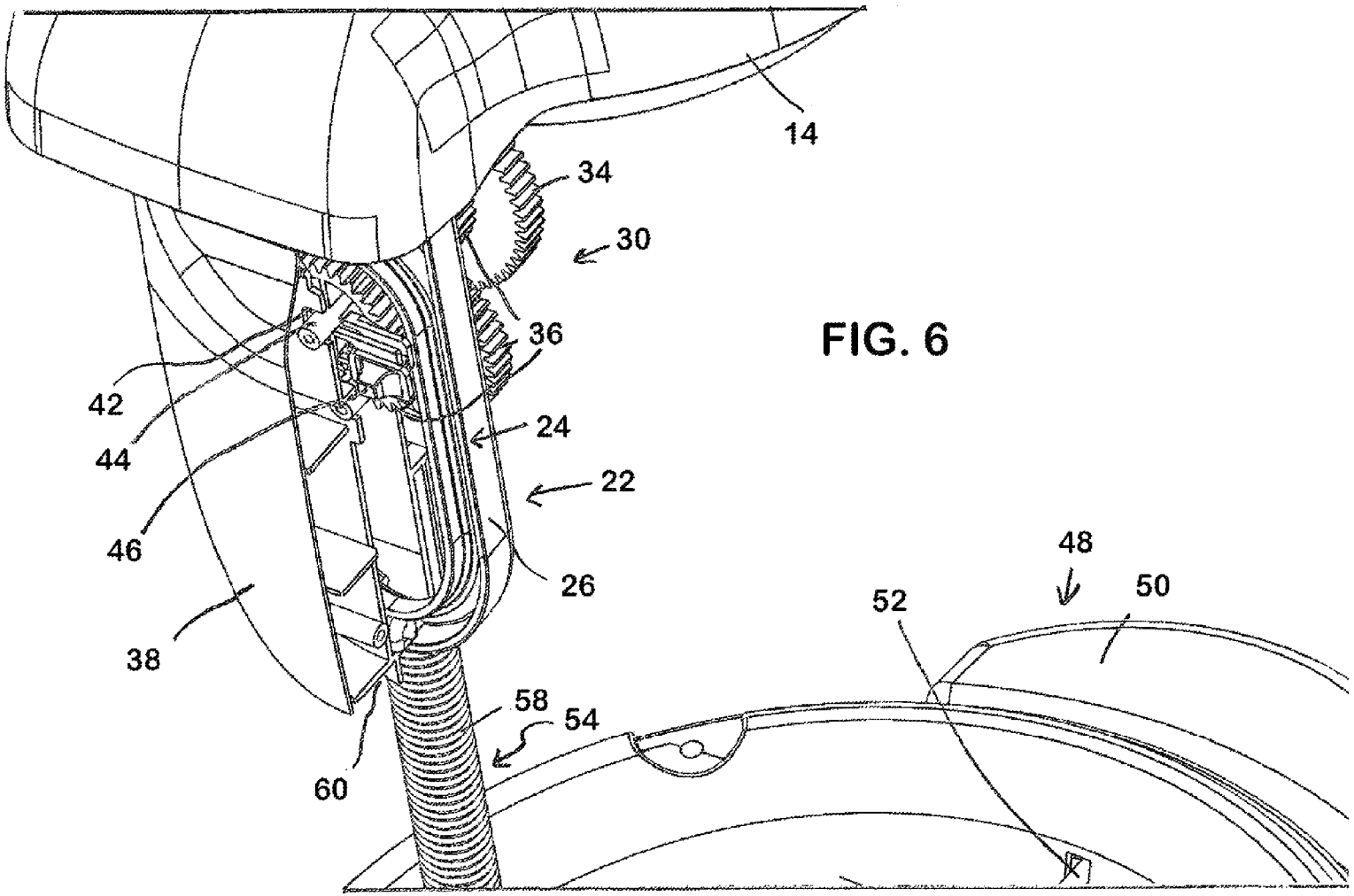
FIGS. 6 and 7 show principal parts of the waste disposal device shown in FIG. 1 when the slide mechanism is in a non-trapping state.
Figure 7:
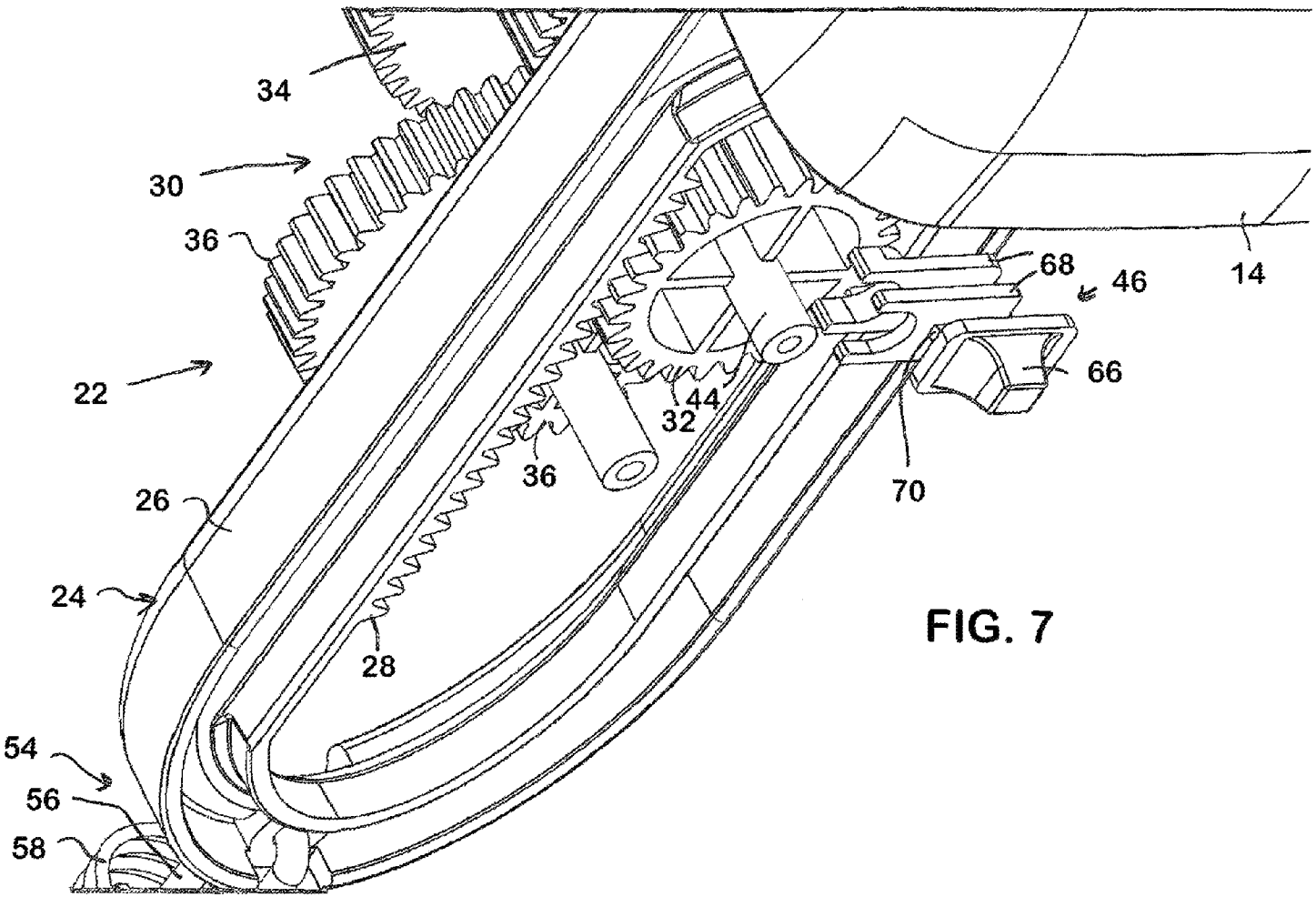
Figure 8:
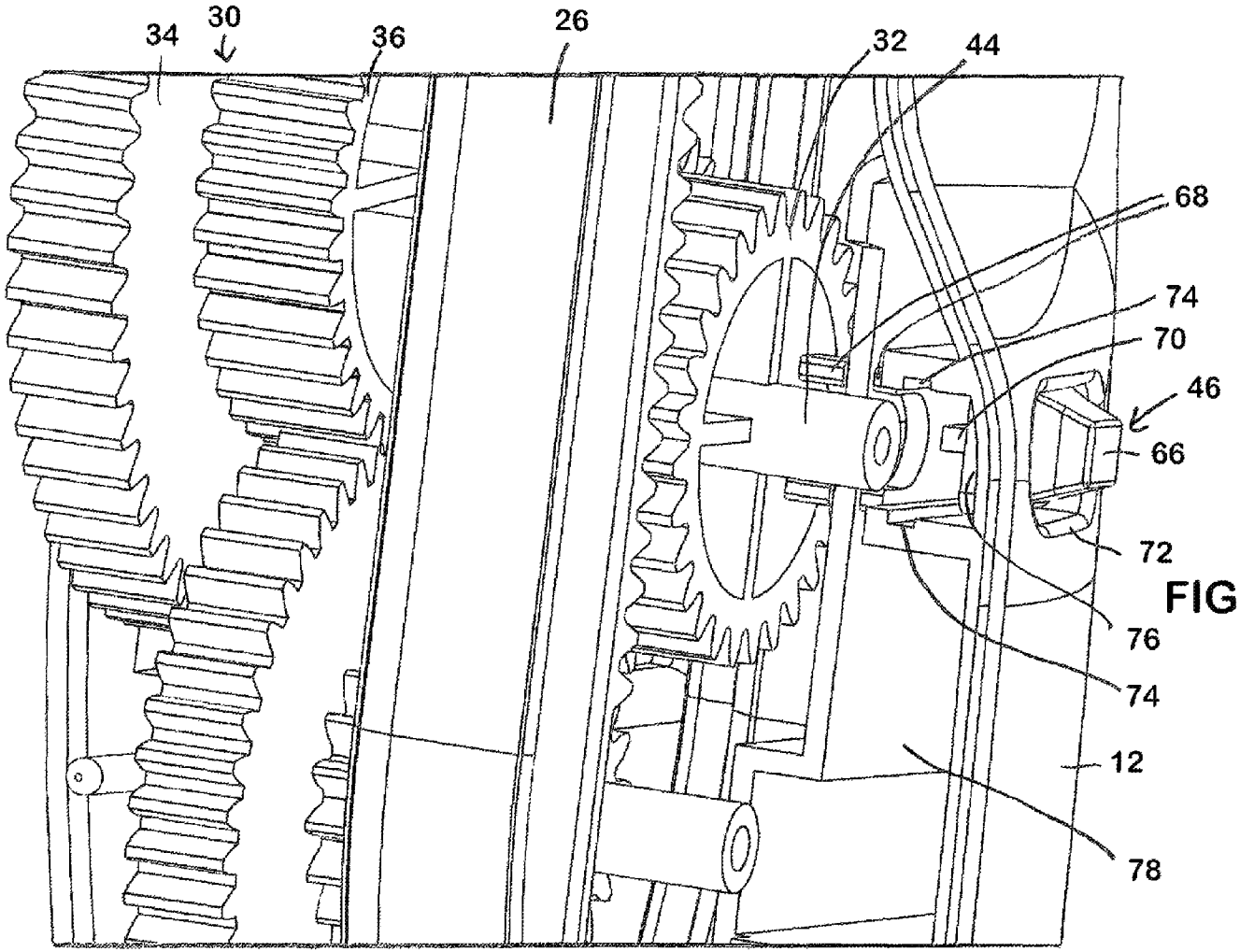
FIG. 8 shows principal parts of the waste disposal device shown in FIG. 1 when a slide mechanism is in a non-trapping state with the wall of the container partially removed.

Movement of the slide mechanisms 46 is guided by opposed grooves 74 formed in a support structure of the container 12 that accommodate, slidingly, lateral edges of a support portion 76 of the slide 66 (see FIGS. 5 and 8).

Engagement of the trapping portions 68 traps the shaft 44 on the same side but also straddles the wall 78 containing the oval slot 42 and engages the shaft 44 on both sides (see FIGS. 5 and 8), thus insuring more surface engagement and stability.

In the trapping portions 68, there may be an extra amount of surface material that engages the shaft 44. This is used primarily to keep the uniform wall thickness to a minimum of the proposed injection molded plastic part(s). The extra protrusion on the trapping portions 68 trap the shaft 44 on the inside of the slot 42. For example, it is possible to add about $1/16^{th}$ of an inch of surface material, because this corresponds to the extra room between the gear 32 and the inner wall along the shaft 44. Taking up that extra space also insures a more stable, positive engagement in trapping the single side of the shaft 44. Furthermore, it provides less "play" which could cause cocking or disengagement otherwise. For these reasons, the slide mechanism 46 with two trapping portions 68 is more advantageous than a slide mechanism with only a single trapping portion.

Alternative constructions of the slide mechanisms 46 have been invented and disclosed in the inventor's earlier patent application referenced above. In one alternative, the slide mechanisms 46 are constructed such that the trapping portions 68 engage shaft 44 on the outside of the wall 78 with the oval slot 42. For example, it is possible that shaft 44 could be extended longer on one side and the slide and slides can have yet more surface engagement.

Yet another embodiment of a waste disposal device in accordance with the invention, which may be a modification or particular use of any of the waste disposal devices disclosed herein, provides an improvement in minimizing or eliminating the common vacuum sucking into the air of airborne odorous and potentially harmful bacteria and fungus. In this regard, reference is made to an Abstract, entitled "Analysis of Airborne Microorganisms from Biohazard Waste Containers" by Sabrina S. Jedlicka et al., which is incorporated by reference herein.

In any of these modified embodiments, with the gear assembly 30 locked to cause the untwisting condition to take place upon opening the lid 14, the previously created knot starts to unwind which always happens (with and without trapping the gear assembly 30). As such, the moment the user "cracks open" the lid 14, even an inch or less, a portion of the knot begins to unwind. Similarly, in the invention, as the lid is lifted, the knot in the bag begins to unwind. Once the lid is lifted a tad, the vacuum seal has been cracked open. The only vacuum draft that will be created, if at all, is between the lid 14 and the upper knotted area of the bag. So, when the lid is lifted up further and the knot unwinds, there is no longer vacuum pressure pulling up the airborne waste matter in the bag as occurs in a conventional step/lid container or pail.

To enhance this effect, the gear assembly 30 may be arranged to have a momentary delay before engagement, although having a knot that has to unwind already breaks the vacuum seal. By breaking the vacuum seal between the lid 14 and the container 12, before the complete unwinding of the knot in the bag, a significant improvement over every other step pedal container or pail on the marketplace is provided Another advantage is that a knot is always created in the bag when the lid 14 closes. By creating a knot in this open/close setting, the build-up of airborne bacteria and fungus that could migrate to the upper inside surface area of the lid is prevented (see the paper mentioned above which addresses some harmful to human bacteria and fungus). Bacteria can be very odorous and by keeping it safely_contained in a knotted bag when the lid 14 is closed, humans are kept safe from offensive smell and potentially harmful contagions.

In some of the embodiments above, the invention involves trapping a shaft 44 of a gear 32 to prevent radial movement of the shaft and thus maintain the gear 32 in meshing engagement with other gears to cause the rotation mechanism 22 to rotate the twisting mechanism 16. Other mechanisms that are effective to prevent radial movement of the gear shaft 44, or the gear 32, yet allow rotation of the gear 32 are also encompassed within the scope and spirit of the invention.

A final waste disposal device in accordance with the invention differs from the waste disposal device 10, in any of the configurations disclosed above, in that it does not include a foot pedal assembly. Rather, such a waste disposal device is operated solely based on manual lifting of the lid 14. The remaining structure of waste disposal device may be the same as waste disposal devices 10, e.g., the slide mechanism in any of its constructions.

Disclosed above is a waste disposal device adapted to receive a waste-containing member and that includes a container defining a waste-receiving compartment having an opening, a lid connected to the container, a rotation mechanism arranged in the container to rotate the waste-containing member, when present, upon closure of the lid, and a slide mechanism including a slide with a double engagement to the shaft. That is, the slide has two trapping portions that engage with and trap the gear shaft, e.g., one on each side of the gear shaft. The slide has a first position in which, when moved into and maintained in the first position, the trapping portions are disengaged from a shaft of a gear and prevents motive force arising from opening of the lid from being converted into actuation of the rotation mechanism and thus precludes rotation of the waste-containing member. The slide has a second position in which, when moved into and maintained in the second position, the trapping portions trap the shaft and allow motive force arising from opening of the lid to convert into actuation of the rotation mechanism and thus unwind the waste-containing member.

A variation of any of the embodiments disclosed herein entails inclusion of a mechanical battery or direct current arrangements that provides energy to a motor. The motor has an on and off position and in the on position, the gear shaft 44 is trapped and in the off position, the gear shaft 44 is not trapped and free to move radially.

An alternative slide mechanism includes a slide with a single engagement to the shaft. That is, the slide may have only a single trapping portion that engages with and traps the gear shaft, e.g., on an outer side of the gear shaft. Another alternative slide mechanism is a knob as disclosed in U.S. patent application Ser. No. 13/173,001.

An indicator may also be provided to indicate the statue of the slide mechanism. The indicator may be a visual indicator, such as a red light or illuminatable icon, whereby the light or icon is illuminated when the waste disposal device is in its state whereby opening and closing of the lid both cause rotation of the twisting mechanism. The light color is red because this state may be best used to dispose of medical waste and biohazardous material which is commonly associated with a red color disposal container. Another icon, or different color light, may be illuminated when the waste disposal device is in its state wherein opening of the lid does not cause untwisting or unwinding of the bag or tubing.

The inventions described above may be used with any number of different waste disposal devices, including waste disposal devices disclosed in U.S. patent application Ser. Nos. 12/172,715 filed Jul. 14, 2008, 12/172,758 filed Jul. 14, 2008 and 12/172,793 filed Jul. 14, 2008, and U.S. provisional patent application Ser. No. 61/362,159 filed Jul. 7, 2010, 61/362,183 filed Jul. 7, 2010, Ser. Nos. 61/366,221 filed Jul. 21, 2010, and 61/409,188 filed Nov. 2, 2010, all of which are incorporated by reference herein. A novelty of the invention with respect to some of the waste disposal devices disclosed in these applications is that the invention provides hands-free use of the waste disposal device. The spring, or other biasing member in the invention, pulls down the lid with the same force as a user would apply if they closed the lid with their hand. The spring closes the lid as its tension or compression is returned to rest, i.e., to its original, normal state, because the spring urges down, for example, a U-channel rack gear which, in turn, is brought into toothed engagement with gears that effect rotation of the waste or the bag or tubing around or above it thereby providing simultaneous closure of the lid and formation of a twist or knot in the bag or tubing above the inserted waste.

The spring, when provided in any of the embodiments disclosed herein or in those of these applications, is advantageous in that it allows for this hands-free operation. By contrast, in conventional waste disposal devices, even those with pedals, there is no spring whose force is used to effect rotation of a twisting mechanism, but rather a damper is usually provided or the lid is tilted forward a tad so as to allow gravity to close the lid. These techniques are believed to be inferior to the invention.

Waste disposal device 10 may be used for any type of waste, including but not limited to medical waste from hospitals, doctors' offices, home health care personnel and facilities, nursing homes, biohazard laboratories, and the like. The waste disposal device 10 may also be used for personal hygiene such as for disposing of soiled diapers.

Modifications to the waste disposal device 10 are envisioned. For example, an access door may be formed in the outer wall of the container 12 to pivot about hinges to enable access to an interior waste-receiving chamber of the container 12 in which another container or pail may be placed to receive a bag which will be filled with waste during use of the waste disposal device 10. A closure mechanism would be provided to secure the door in a closed position.

While particular embodiments of the invention have been shown and described, it will be obvious to those skilled in the art that changes and modifications may be made without departing from the invention in its broader aspects, and, therefore, the aim in the appended claims is to cover all such changes and modifications as fall within the true spirit and scope of the invention. For example, although the rotation mechanism 18 is described above to rotate a twisting mechanism relative to a stationary support or cartridge which supports or retains a waste-containing member, it is conceivable that the same rotation mechanism can be arranged to rotate a support or cartridge which supports or retains a waste-containing member relative to a stationary twisting mechanism.

The invention claimed is:

1. A waste disposal device adapted to receive a waste-containing member, comprising:

a container defining a waste-receiving compartment having an opening;

a lid connected to said container;

a rotation mechanism arranged in said container to rotate the waste-containing member when present in said container, said rotation mechanism comprising at least one member coupled to said lid and arranged such that movement of said at least one member causes rotation of the waste-containing member;

a slide mechanism that is set to one of two different positions to regulate rotation of the waste-containing member based on opening movement of said lid such that when said slide mechanism is in one position, the opening movement of said lid causes said rotation mechanism to rotate the waste-containing member and when said slide mechanism is in the other position, the opening movement of said lid does not cause said rotation mechanism to rotate the waste-containing member, and a foot pedal assembly comprising a depressible foot pedal and a spring, said foot pedal assembly being arranged to cause both opening of said lid when said foot pedal is depressed and closure of said lid when the pressing force is removed, said spring being arranged to be moved against its bias upon depression of said foot pedal and return to its original state when the pressing force is removed, and said spring being coupled to said at least one member such that when said spring returns to its original state, said spring pulls said at least one member downward and thereby causes closure of said lid coupled to said at least one member and rotation of the waste-containing member.

2. The device of claim 1, wherein said rotation mechanism includes at least one gear and said slide mechanism has a double engagement on two parts of a gear shaft about which said at least one gear rotates.

3. The device of claim 2, wherein said slide mechanism comprises a manually accessible slide and two trapping portions that trap said gear shaft to thereby retain said gear shaft and prevent radial movement of said gear shaft and thus radial movement of said at least one gear.

4. The device of claim 2, wherein said slide mechanism comprises a support portion and said container defines grooves for guiding said support portion and thus guiding movement of said slide mechanism.

5. The device of claim 1, wherein said rotation mechanism includes at least one gear, said slide mechanism comprising a manually accessible and movable slide and at least one trapping portion that is moved upon movement of said slide in one direction to cause said at least one trapping portion to trap a gear shaft about which said at least one gear rotates and also moved upon movement of said slide in an opposite direction to cause said at least one trapping portion to move out of engagement with said gear shaft and thereby allow radial movement of said gear shaft.

6. The device of claim 1, wherein said rotation mechanism comprises:

at least one rack gear coupled to said lid;

a gear assembly having a first gear in meshing engagement with said at least one rack gear, and a second, drive gear in meshing engagement with the waste-containing member and which is rotationally coupled to said first gear; and a frame pivotally coupled to the lid at an upper end region thereof, said at least one rack gear being arranged on an inside surface of a respective leg of said frame.

7. The device of claim 1, wherein said rotation mechanism comprises a first member coupled to said lid, and a force transmission mechanism having a second member engaging with said first member coupled to said lid and a third member engaging with the waste-containing member and which is motively coupled to said second member.

8. The device of claim 7, wherein said first member comprises a rack gear, and said second and third members comprise gears rotationally coupled together.

9. The device of claim 1, wherein said at least one member is at least one rack gear, said rotation mechanism further comprising:

a gear assembly having a first gear in meshing engagement with said at least one rack gear and a second, drive gear in meshing engagement with the waste-containing member and which is rotationally coupled to said first gear; and a frame pivotally coupled to said lid at an upper end region thereof, said at least one rack gear being arranged on said frame, said spring being connected to said frame.

10. The device of claim 1, further comprising retaining members for retaining upper and lower ends of said spring.

11. The device of claim 1, wherein said foot pedal assembly further includes a horizontal actuating member connected to said foot pedal at a first end region and said spring is a compression spring and is part of a spring assembly, said spring assembly further comprising a rod around which said spring is positioned, said rod being attached at a lower end region to said horizontal actuating member and at an upper end region to said rotation mechanism.

12. The device of claim 11, wherein said at least one member is at least one rack gear, said rotation mechanism further comprising:

a gear assembly having a first gear in meshing engagement with said at least one rack gear and a second, drive gear in meshing engagement with the waste-containing member and which is rotationally coupled to said first gear; and a frame pivotally coupled to said lid at an upper end region thereof, said at least one rack gear being arranged on said frame, said rod being connected to said frame.

13. The device of claim 11, wherein said rod includes a portion that extends through a slot in said horizontal actuating member, said rod being fixed to said horizontal actuating member in a manner to allow said portion is be movable in said slot.

14. A waste disposal device adapted to receive a waste-containing member, comprising:

a container defining a waste-receiving compartment having an opening;

a lid connected to said container;

rotation means coupled to said lid for rotating the waste-containing member when present in said container;

slide means for regulating rotation of the waste-containing member based on opening movement of said lid such that when said slide means is in one position, the opening movement of said lid causes said rotation means to rotate the waste-containing member and when said slide means is in the other position, the opening movement of said lid does not cause said rotation means to rotate the waste-containing member, and a foot pedal assembly comprising a depressible foot pedal and a spring, said foot pedal assembly being arranged to cause both opening of said lid when said foot pedal is depressed and closure of said lid when the pressing force is removed, said spring being arranged to be moved against its bias upon depression of said foot pedal and return to its original state when the pressing force is removed, and said spring being coupled to said rotation means such that when said spring returns to its original state, said spring causes closure of said lid and rotation of the waste-containing member.

15. The device of claim 14, wherein said rotation means includes at least one gear and said slide means has a double engagement on two parts of a gear shaft about which said at least one gear rotates.

16. The device of claim 15, wherein said slide means comprises a manually accessible slide and two trapping portions that trap said gear shaft to thereby retain said gear shaft and prevent radial movement of said gear shaft and thus radial movement of said at least one gear.

17. The device of claim 15, wherein said slide means comprises a support portion and said container defines grooves for guiding said support portion and thus guiding movement of said slide means.

18. The device of claim 14, wherein said rotation means includes at least one gear, said slide means comprising a manually accessible and movable slide and at least one trapping portion that is moved upon movement of said slide in one direction to cause said at least one trapping portion to trap a gear shaft about which said at least one gear rotates and also moved upon movement of said slide in an opposite direction to cause said at least one trapping portion to move out of engagement with said gear shaft and thereby allow radial movement of said gear shaft.

19. The device of claim 14, wherein said rotation means comprises:

at least one rack gear coupled to said lid;

a gear assembly having a first gear in meshing engagement with said at least one rack gear, and a second, drive gear in meshing engagement with the waste-containing member and which is rotationally coupled to said first gear; and a frame pivotally coupled to the lid at an upper end region thereof, said at least one rack gear being arranged on an inside surface of a respective leg of said frame.

20. The device of claim 14, wherein said rotation means comprises a first member coupled to said lid, and a force transmission mechanism having a second member engaging with said first member coupled to said lid and a third member engaging with the waste-containing member and which is motively coupled to said second member.

* * * * *